US007663867B2

(12) United States Patent
Rane et al.

(10) Patent No.: US 7,663,867 B2
(45) Date of Patent: Feb. 16, 2010

(54) SECONDARY CIRCUIT TERMINAL BLOCK DESIGN FOR FIXED TYPE CIRCUIT BREAKERS

(75) Inventors: Mahesh Jaywant Rane, Secunderabad (IN); Simhadri Ramalingeswara Rao Gupta, Andra Pradesh (IN); Janakiraman Narayanan, Andra Pradesh (IN); Pankaj Agrawal, Bangalore (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/103,157

(22) Filed: Apr. 15, 2008

(65) Prior Publication Data

US 2009/0257173 A1 Oct. 15, 2009

(51) Int. Cl.
*H01H 71/08* (2006.01)

(52) U.S. Cl. ..... 361/636; 361/605; 361/627; 361/634; 361/652; 439/595; 439/709

(58) Field of Classification Search ..... 361/602–611, 361/624, 627, 632–639, 648–649, 650–659, 361/645, 667, 673, 832; 439/505–518, 668, 439/709–722, 810–814, 780–793; 200/17 R, 200/50.01, 50.02, 50.21, 50.23, 306, 289, 200/293–305, 307, 308; 174/72 B, 88 B, 174/149 B See application file for complete search history.

(56) References Cited

U.S. PATENT DOCUMENTS

| | | | | |
|---|---|---|---|---|
| 4,504,885 | A * | 3/1985 | Yoshikawa et al. | 361/614 |
| 5,594,221 | A | 1/1997 | Drumbor et al. | |
| 5,870,278 | A * | 2/1999 | Girard et al. | 361/627 |
| 6,160,229 | A * | 12/2000 | Grelier et al. | 200/50.26 |
| 6,215,654 | B1 * | 4/2001 | Wilkie et al. | 361/605 |
| 6,262,880 | B1 * | 7/2001 | Fischer et al. | 361/652 |
| 6,388,867 | B1 * | 5/2002 | Rakus et al. | 361/605 |
| 7,336,477 | B2 * | 2/2008 | Weister et al. | 361/676 |
| 7,394,632 | B2 * | 7/2008 | Arguello et al. | 361/62 |

FOREIGN PATENT DOCUMENTS

| | | | |
|---|---|---|---|
| EP | 768727 | A1 * | 4/1997 |
| EP | 1798744 | A1 * | 6/2007 |
| JP | 406119865 | A * | 4/1994 |

* cited by examiner

*Primary Examiner*—Michael V Datskovskiy
(74) *Attorney, Agent, or Firm*—GE Global Patent Operation

(57) ABSTRACT

A circuit breaker apparatus is provided and includes a circuit breaker, having a housing surface perpendicular to a plane of a front side of the circuit breaker and internal components, a terminal block structurally coupled to the housing surface, first terminal housings arrayed on the terminal block to each support first components and to be receptive of second terminal housings each of which supports second components, at least some of which are electrically coupled to the internal components, to be electrically coupled to at least some of the first components, and an access block. The access block is disposed on the terminal block and has apertures defined therein to provide for front-side access to the first terminal housings.

20 Claims, 6 Drawing Sheets

SECONDARY CIRCUIT TERMINAL BLOCK DESIGN FOR FIXED TYPE CIRCUIT BREAKERS

BACKGROUND OF THE INVENTION

Aspects of the present disclosure are directed to fixed type circuit breakers and, more particularly, to fixed type circuit breakers having a secondary circuit terminal block.

BRIEF DESCRIPTION OF THE BACKGROUND

Circuit breakers are capable of interrupting high ampere current in various industrial, commercial or personal electrical applications and may be categorized generally as draw-out types of circuit breakers and fixed types of circuit breakers. In that capacity, both types of circuit breakers may be attached to circuitry and, in particular, to a switchboard with limited spatial capacity. As such, it is desirable to construct both types of circuit breakers with increasingly smaller and smaller components without sacrificing accessibility.

In conventional fixed types of circuit breakers, compact size has been accomplished through the use of secondary control circuits. In secondary control circuits, a terminal block is provided and includes terminals to which corresponding terminals of accessory plugs are indirectly connected. These terminals are, however, not front-side accessible. As such, given the above-noted spatial limitations, it may be difficult or impossible for an operator to conduct wiring processes of the terminals in a completed installation.

SUMMARY OF THE INVENTION

In accordance with an aspect of the invention, a circuit breaker apparatus is provided and includes a circuit breaker, having a housing surface perpendicular to a plane of a front side of the circuit breaker and internal components, a terminal block structurally coupled to the housing surface, first terminal housings arrayed on the terminal block to each support first components and to be receptive of second terminal housings each of which supports second components, at least some of which are electrically coupled to the internal components, to be electrically coupled to at least some of the first components, and an access block disposed on the terminal block and having apertures defined therein to provide for front-side access to the first terminal housings.

In accordance with another aspect of the invention, a circuit breaker apparatus is provided and includes a circuit breaker, having a housing surface perpendicular to a plane of a front side of the circuit breaker and internal components, a terminal block structurally coupled to the housing surface, first terminal housings arrayed on the terminal block to each support first components, second terminal housings, each of which supports second components at least some of which are electrically coupled to the internal components, received within the first terminal housings such that the second components are electrically coupled to at least some of the first components, and an access block disposed on the terminal block and having apertures defined therein to provide for front-side access to the first terminal housings.

In accordance with another aspect of the invention, a circuit breaker apparatus is provided and includes a circuit breaker, having a housing surface perpendicular to a plane of a front side of the circuit breaker and internal components, a terminal block structurally coupled to the housing surface, female terminal housings arrayed on the terminal block to each support a female terminal, male terminal housings, each of which supports a male terminal at least some of which are electrically coupled to the internal components, received within the female terminal housings such that the male terminals are electrically coupled to at least some of the female terminals, and an access block disposed on the terminal block and having apertures defined therein to provide for front-side access to the female terminal housings.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTIONS OF THE DRAWINGS

The subject matter regarded as the invention is particularly pointed out and distinctly claimed in the claims at the conclusion of the specification. The foregoing and other aspects, features, and advantages of the invention are apparent from the following detailed description taken in conjunction with the accompanying drawings in which:

DETAILED DESCRIPTION OF THE INVENTION

Figure 1:
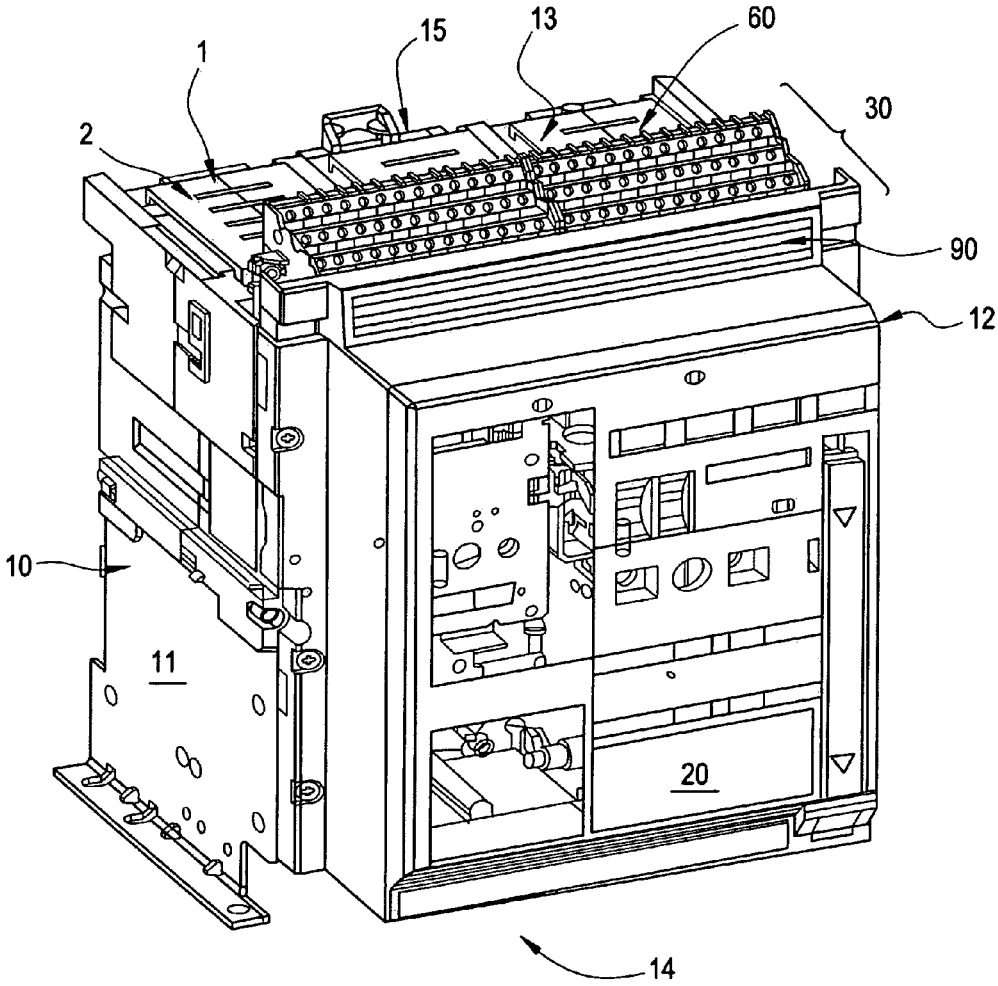
FIG. 1 is a perspective view of a circuit breaker apparatus according to an embodiment of the present invention.

With reference to FIGS. 1-5, a fixed type of a circuit breaker apparatus 1 is provided. The circuit breaker apparatus 1 includes a circuit breaker 2, which is attachable to a switchboard (not shown). The circuit breaker 2 includes external mounting plates 10 and internal components 20. The external mounting plates 10 are two in number, one on either side of the circuit breaker housing, which may further include housing surfaces 11, 12 and 13, bottom region 14 and rear region 15 and which forms an interior region in which the internal components 20 are operably disposed. A terminal block 30 of, for example, a secondary disconnect of the circuit breaker 2, is coupled to one of the housing surfaces 11, 12 and 13.

Here, it is noted that, FIG. 1 illustrates that the terminal block 30 is coupled to housing surface 13, which is provided as the top surface of the circuit breaker 2. However, it is understood that embodiments of the invention exist in which the terminal block 30 is attached to other housing surfaces, such as, for example, housing surfaces 11 or 12, in a similar manner.

Female terminal housings 40 are arrayed on the terminal block 30 to each support a female terminal 41 therein. Male terminal housings 50, each of which may support a male terminal 51 therein are received within at least some of the female terminal housings 40 such that the male terminals 51 are electrically coupled to the female terminals 41. Further, at least some of the male terminals 51 are also electrically coupled to the internal components 20 via male terminal wiring 52. In this way, electrical connections may be formed between the internal components 20 and the female terminals 41. An access block 60 is disposed on the terminal block 30 and has apertures 61 defined therein to provide for front-side access to female terminal wiring 42 of the female terminal housings 40. Here, it is noted that, in an embodiment of the invention, the female terminals 41 and the female terminal wiring 42 may be one single component made of a copper alloy.

Figure 4:
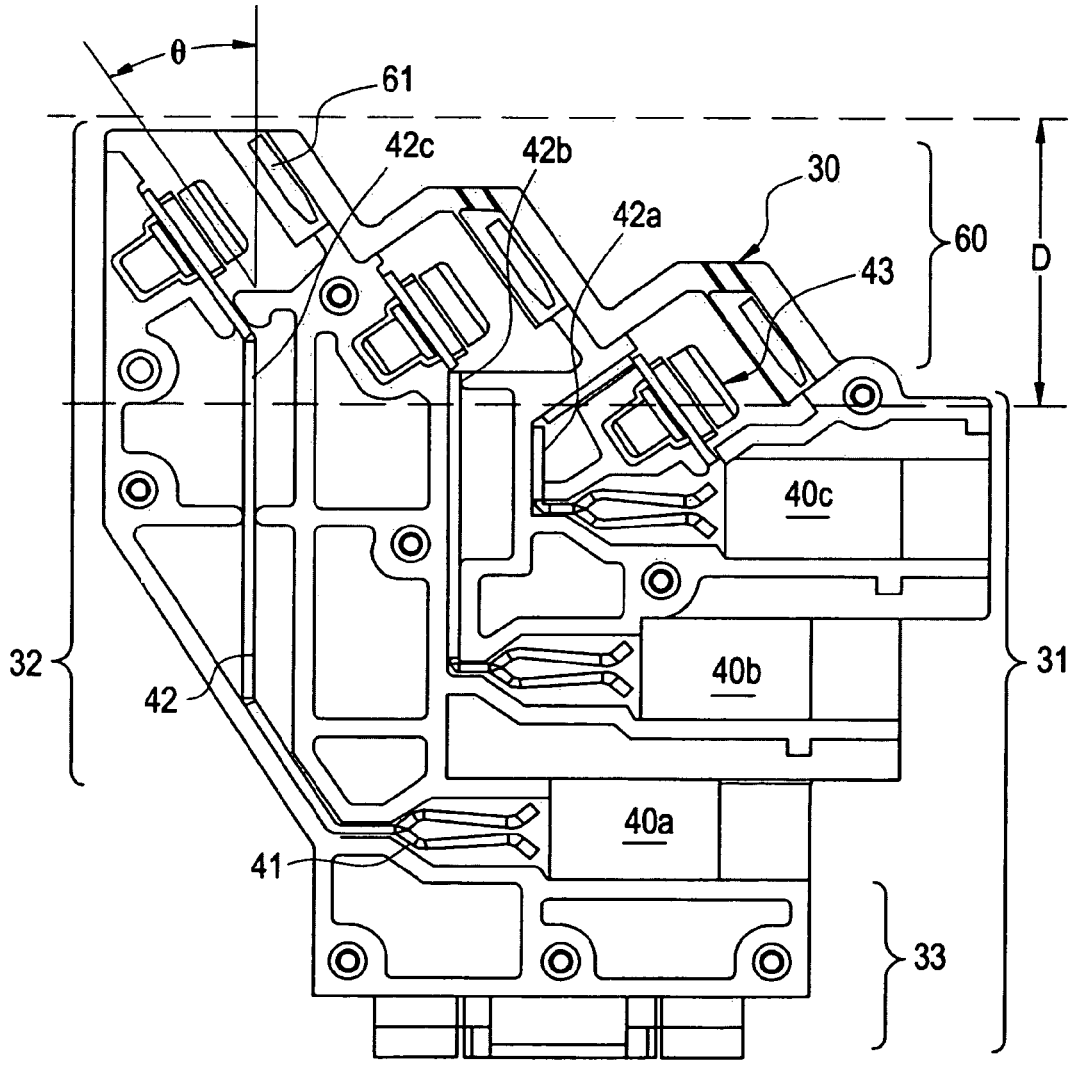
FIG. 4 is a side sectional view of the terminal block according to an embodiment of the present invention.
Figure 5:
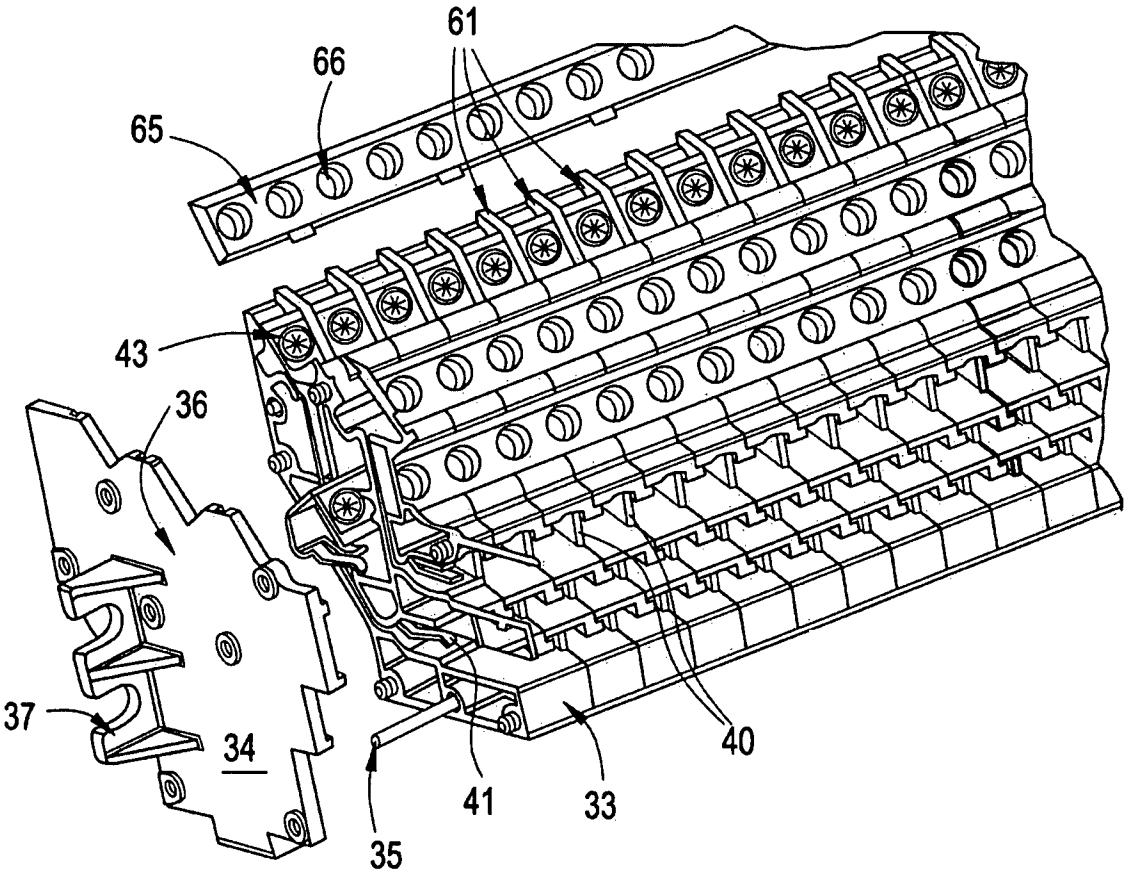
FIG. 5 is a exploded perspective view of the terminal block according to an embodiment of the present invention.

With particular reference to FIGS. 4 and 5, the terminal block 30 includes a first portion 31 and a second portion 32. The first portion 31 is disposed proximate to the housing surface 13 and includes the array of the female terminal housings 40 and a base 33. The second portion 32 is disposed substantially rearward of and laterally outside of the first portion 31 with respect to the housing surface 13. That is, a section of the second portion 32 is disposed proximate to the housing surface 13 and other sections of the second portion 32 are located at greater lateral distances from the housing surface 13 than any sections of the first portion 31. The terminal block 30 further includes a pair of end covers 34 at opposing ends thereof to cap an interior of the terminal block 30 as well as a guide pin 35 extending through the base 33 and which aligns the end covers 34. In an embodiment of the invention, external faces 36 of the end covers 34 are provided with mounting structures 37 by which the terminal block 30 may be secured to an external structure. In a further embodiment of the invention, the guide pin 35 is a long stainless steel pin that extends from one end cover 34 to the other and thereby provides rigidity to the terminal block 30.

Figure 3A:
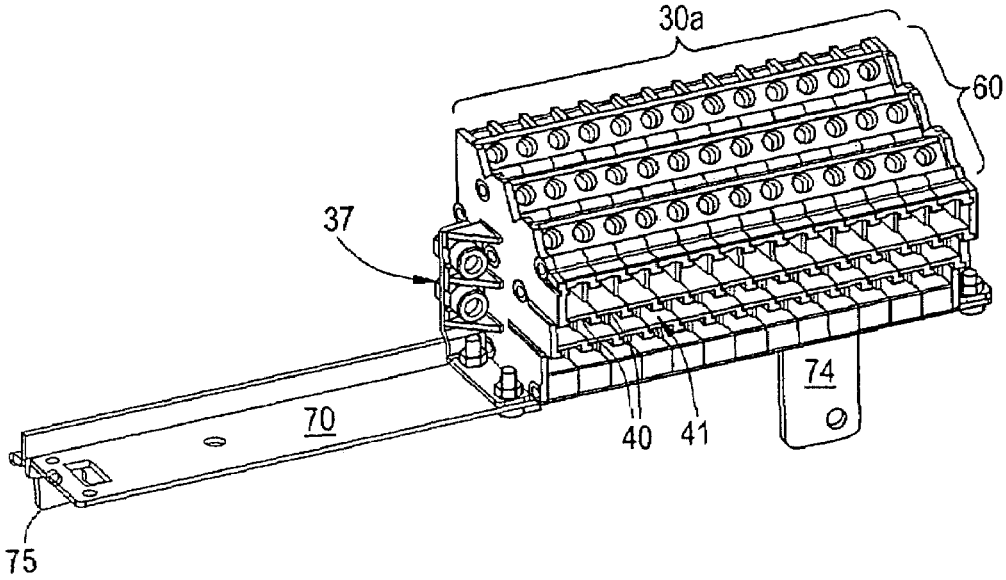
FIGS. 3A and 3B are perspective views of embodiments of the terminal block according to embodiments of the present invention.
Figure 6A:
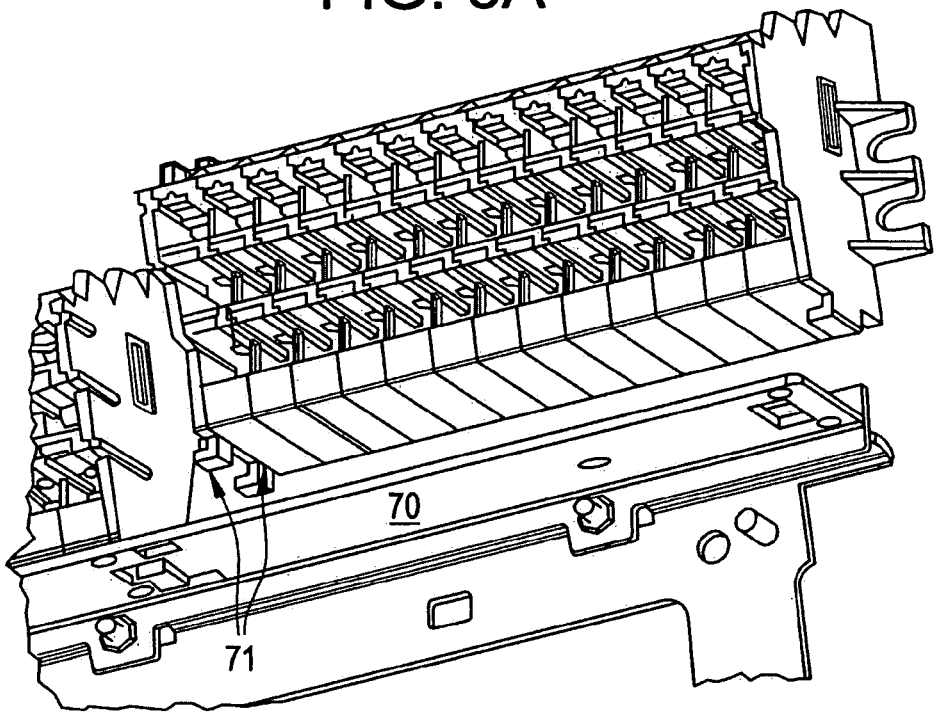
FIGS. 6A and 6B are perspective views of a mounting of the terminal block according to an embodiment of the present invention.
Figure 6B:
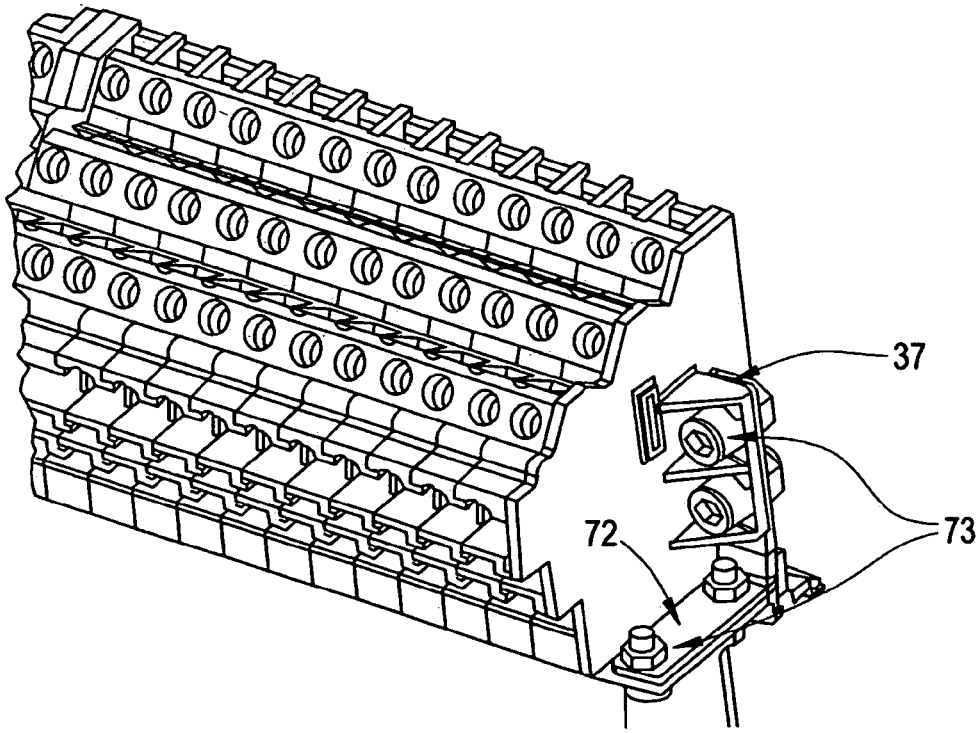

With reference to FIGS. 3A, 6A and 6B, the terminal block 30 is coupled to the circuit breaker 2 via a bracket 70, which is disposed between the circuit breaker 2 and the terminal block 30. The connection between the terminal block 30 and the bracket 70 may be accomplished via first locking elements 71, which may comprise elastic hooks or other similar features, and which may be integrally connected to the end covers 34. The bracket 70, meanwhile, may be connected to the circuit breaker 2 via second locking elements 72 and 73. Here, the second locking elements 72 and 73 may respectively include a mounting washer and mounting screws, some of which may be applied to secure the mounting structures 37 to the external structures, or other similar features. Flanges 74 and 75 may be additionally employed to secure the bracket 70 to the circuit breaker 2.

Figure 3B:
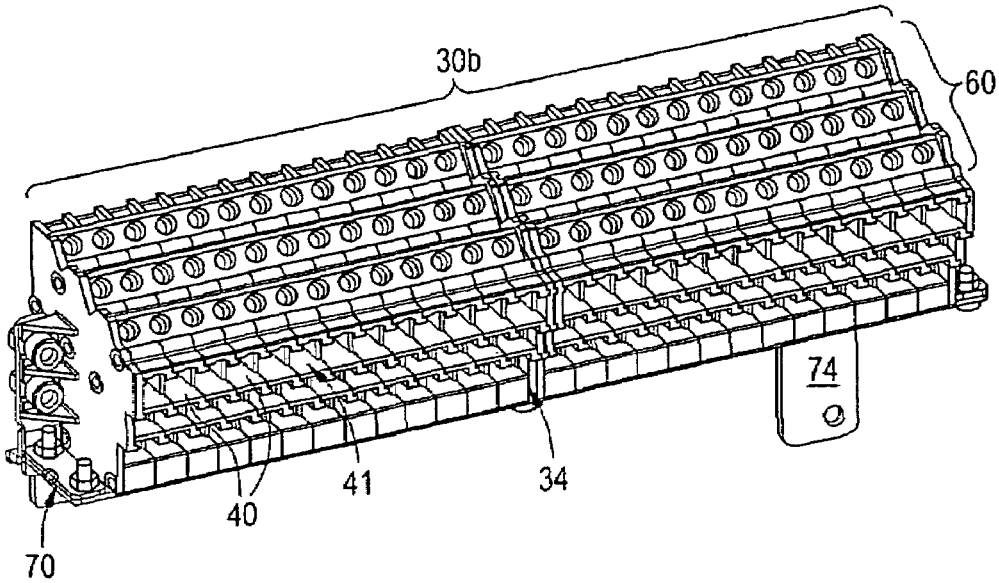

With this construction, the terminal block 30 may be provided as a single block 30*a*, as shown in FIG. 3A, that extends wholly or partly across the bracket 70, or as a plurality of blocks 30*b*, as shown in FIG. 3B. Where the terminal block 30 is provided as the plurality of blocks 30*b*, the end covers 34 disposed between the adjacent terminal blocks 30 may be attached in various manners to one another and would not include the mounting structures 37.

In either case, each terminal block 30 may include several rows of female terminal housings 40 in several columns thereof and, according to an embodiment of the invention, each terminal block 30 may include three rows of the female terminal housings 40 in thirteen columns thereof, however, these values are for illustration purposes only and are not limiting to the scope of the invention disclosed herein. The female terminal housings 40 are arrayed in the row-column format on the terminal block 30 within the first portion 31 thereof. In this arrangement, the female terminal housings 40 are further arrayed in an increasingly forward step-wise formation. That is, as shown in FIG. 4, a row of the female terminal housings 40*a* closest to the base 33 is also the most withdrawn from a forward extension of the terminal block 30 while a row of the female terminal housings 40*c* furthest from the base 33 occupies a forward-most position, with a middle row of the female terminal housings 40*b* interposed between female terminal housing rows 40*a* and 40*c*.

Given the step-wise formation of the array of the female terminals 40, male terminal wiring 52 coupled to a forward end of each of the male terminal housings 50 when the male terminal housings 50 are inserted into the female terminal housings 40 is threaded toward the internal components 20 of the circuit breaker 2 in rows corresponding to the increasingly step-wise formation of the female terminal housings 40. That is, where first and second male terminal housings 50 are respectively received within female terminal housing row 40*a* and female terminal housing row 40*c*, the male terminal wiring 52 for the first male terminal housing 50 will be threaded at a rear of the male terminal wiring 52 for the second male terminal housing 50.

With reference to FIGS. 4 and 5, the access block 60 is disposed on the second portion 32 of the terminal block 30 and has apertures 61 defined therein to provide for front-side access to the female terminal housings 40. Such access may be exploited by an operator of the circuit breaker apparatus 1 to configure, re-configure or otherwise repair the female terminal wiring 42 for the female terminal housings 40, which may include screw type terminals including a terminal screw 43 and the female terminal wiring 42 therein. In this capacity and to limit a lateral extension D of the terminal block 30, the access block 60 is configured such that the apertures 61 are arranged in an increasingly rearward inclined step-wise formation. Thus, it may be seen that the arrangement of the apertures 61 opposes that of the female terminal housings 40. That is, a forward-most row of apertures 61 is closest to the housing surface 13 and provides for front-side access to the row of the female terminal housings 40*c* that are furthest from the housing surface 13 via the forward-most row of female terminal wiring 42*a*. Similarly, a third and rear-most row of apertures 61 provides for front-side access to row of the female terminal housings 40*a* that are closest to the housing surface 13 via a rear-most row of female terminal wiring 42*c* with the middle row of female terminal wiring 42*b* interposed between female terminal wiring rows 42*a* and 42*c*.

Here, since a plane of the apertures 61 is inclined, while each of the apertures 61 provides for the above-described front-side access, the lateral extension D of the terminal block 30 is limited. Moreover, since the angle θ of the inclination of each aperture 61 is only slightly angled (by, for example, 30°) from the plane of the front side of the circuit breaker 2, the operator may access each of the terminal screws at a normal angle or, at worst, at an angle corresponding to the angle θ of the inclination of the apertures 61.

With further reference to FIG. 5, it may be seen that the access block 60 includes a protection covering 65 that is removably installed thereon. The protection covering 65 includes holes 66 defined therein at locations which correspond to those of the apertures 61 when the protection covering 65 is installed on the access block 60. In accordance with an embodiment of the invention, the protection covering 65 may include a set of IP20 protection covers.

Figure 2:
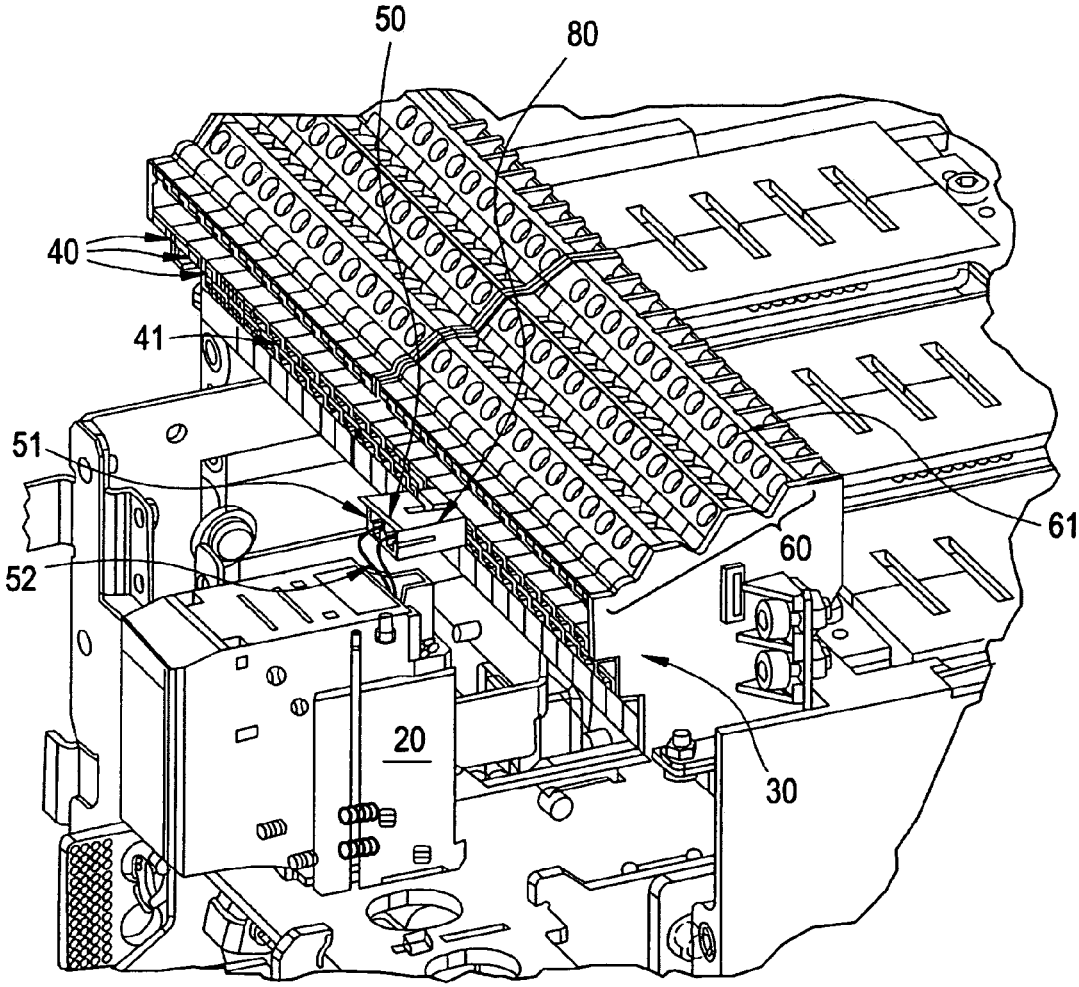
FIG. 2 is an enlarged perspective view of a terminal block of the circuit breaker of FIG. 1.

With reference to FIG. 2, in accordance with an embodiment of the invention, at least some of the male terminal housings 50 may include an accessory plug 80. Here, such an accessory plug 80 may include one or more male terminal housings 50 and may be previously inserted into corresponding numbers of female terminal housings 40 during manufacturing processes of the circuit breaker 2. Alternately, they may be front-side inserted by the operator at any time during the lifecycle of the circuit breaker 2. In any case, the male terminal housings 50 are received as accessory plugs 80 or simply as male terminal housings 50 in the female terminal housings 40 in a snap-in configuration. Moreover, the male terminal wiring 52 and the male terminals 51 may be crimped together so as to limit a number of required electrical joints between the female terminals 41 and the internal components 20 or other devices to which the male terminal wiring 52 is coupled.

With reference to FIG. 1, the circuit breaker 2 may further include a cover 90 that is removably attached to a forward facing surface of the terminal block 30. In this manner, the male terminal housings 50 and the male terminal wiring 52 may be hidden from view and the external appearance of the circuit breaker 2 may be improved. Moreover, the cover 90 may provide protection from external forces to the various components described above and may thereby lengthen the expected lifecycle of the circuit breaker 2 while simultaneously reducing an expected number of service requirements.

In accordance with various aspects of the present invention, a number of female and male terminals 41 and 51 that could be used by a fixed type of circuit breaker may be increased beyond what is presently possible given current spatial limitations. That is, as shown in FIG. 3A and as noted above, the terminal block 30*a* may include 3 rows of 13 columns of female terminal housings 40, which is an increase in the number of female terminal housings 40 over other designs.

Although the embodiments described above are partly characterized by the female terminal housings 40 being arrayed on the terminal block 30, it is understood that this arrangement could be partly or entirely reversed. Where it is partly reversed, terminal block 30 could support both female and male terminal housings 40 and 50 in various combinations and patterns.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular exemplary embodiment disclosed as the best mode contemplated for carrying out this disclosure, but that the disclosure will include all embodiments falling within the scope of the appended claims.

We claim:

1. A circuit breaker apparatus, comprising:

a circuit breaker, having a housing surface perpendicular to a plane of a front side of the circuit breaker and internal components;

a terminal block coupled to the housing surface;

first terminal housings arrayed on the terminal block to each support first components and to be receptive of second terminal housings each of which supports second components, at least some of which are electrically coupled to the internal components, to be electrically coupled to at least some of the first components; and an access block disposed on the terminal block and having apertures defined therein to provide for front-side access to the first terminal housings.

2. The circuit breaker apparatus according to claim 1, wherein the terminal block is a secondary circuit terminal block.

3. The circuit breaker apparatus according to claim 1, further comprising a bracket, on which the terminal block is mountable, to be removably installed on the housing surface.

4. The circuit breaker apparatus according to claim 3, wherein the terminal block is mounted on the bracket as a single block.

5. The circuit breaker apparatus according to claim 3, wherein the terminal block is mounted on the bracket as a plurality of blocks.

6. The circuit breaker apparatus according to claim 1, wherein the terminal block comprises a first portion disposed proximate to the housing surface and a second portion disposed substantially rearward of and outside of the first portion.

7. The circuit breaker apparatus according to claim 6, wherein the first terminal housings are arrayed on the terminal block within the first portion thereof.

8. The circuit breaker apparatus according to claim 6, wherein the first terminal housings are arrayed on the terminal block within the first portion thereof in an increasingly forward step-wise formation.

9. The circuit breaker apparatus according to claim 8, wherein wiring coupled to a forward end of each of the second terminal housings is threaded toward the internal components of the circuit breaker in rows corresponding to the increasingly forward step-wise formation of the first terminal housings.

10. The circuit breaker apparatus according to claim 6, wherein the access block is disposed within the second portion of the terminal block.

11. The circuit breaker apparatus according to claim 6, wherein the access block is disposed within the second portion of the terminal block and configured such that the apertures defined therein are arranged in an increasingly rearward inclined step-wise formation.

12. The circuit breaker apparatus according to claim 11, wherein the first components comprise screw type terminals each of which includes wiring accessible through corresponding ones of the apertures.

13. The circuit breaker apparatus according to claim 1, wherein the access block comprises a protection covering removably installed thereon.

14. The circuit breaker apparatus according to claim 1, wherein the first components comprise female terminals and the first terminal housings comprise female terminal housings.

15. The circuit breaker apparatus according to claim 1, wherein the second components comprise male terminals and the second terminal housings comprise male terminal housings.

16. The circuit breaker apparatus according to claim 1, wherein at least one of the second terminal housings comprises an accessory plug.

17. The circuit breaker apparatus according to claim 16, wherein a corresponding number of the first terminal housings are receptive of the accessory plug in a snap-in configuration.

18. The circuit breaker apparatus according to claim 1, further comprising a cover removably attached to a forward facing surface of the terminal block.

19. A circuit breaker apparatus, comprising:

a circuit breaker, having a housing surface perpendicular to a plane of a front side of the circuit breaker and internal components;

a terminal block coupled to the housing surface;

first terminal housings arrayed on the terminal block to each support first components;

second terminal housings, each of which supports second components at least some of which are electrically coupled to the internal components, received within the first terminal housings such that the second components are electrically coupled to at least some of the first components; and an access block disposed on the terminal block and having apertures defined therein to provide for front-side access to the first terminal housings.

20. A circuit breaker apparatus, comprising:

a circuit breaker, having a housing surface perpendicular to a plane of a front side of the circuit breaker and internal components;

a terminal block coupled to the housing surface;

female terminal housings arrayed on the terminal block to each support a female terminal;

male terminal housings, each of which supports a male terminal at least some of which are electrically coupled to the internal components, received within the female terminal housings such that the male terminals are electrically coupled to at least some of the female terminals; and an access block disposed on the terminal block and having apertures defined therein to provide for front-side access to the female terminal housings.

* * * * *